US005628254A

United States Patent [19]

Ott et al.

[11] Patent Number: 5,628,254

[45] Date of Patent: May 13, 1997

[54] MOISTURE BARRIER, FILTER SEAL FOR HOPPER RAIL CAR HATCHES

[75] Inventors: Michael A. Ott, Spring; Alfred W. Hendee, Houston; Charles C. Hendee, Sugar Land, all of Tex.

[73] Assignees: Hendee Enterprises, Inc., Houston, Tex.; Salco Products, Inc., Romeoville, Ill.

[21] Appl. No.: 516,799

[22] Filed: Aug. 18, 1995

[51] Int. Cl.[6] ..... B61D 49/00

[52] U.S. Cl. ..... 105/377.08; 220/203.08

[58] Field of Search ..... 105/358, 360, 105/377.02, 377.05, 377.07, 377.08, 248, 247; 220/89.2, 203.8, 371, 372, 373, 745; 55/309, 310, 311; 209/400, 401; 222/152, 189.08, 189.09, 630; 406/118, 119, 120, 145

[56] References Cited

U.S. PATENT DOCUMENTS

| | | | |
|---|---|---|---|
| Re. 24,916 | 12/1960 | Oliver . | |
| 2,629,637 | 2/1953 | Hornbrook . | |
| 2,650,726 | 9/1953 | Aller et al. . | |
| 2,695,196 | 11/1954 | Talmey et al. | 105/248 |
| 2,732,092 | 1/1956 | Lawrence | 220/371 |
| 2,844,411 | 7/1958 | Aller . | |
| 2,962,325 | 11/1960 | Dorey . | |
| 3,105,721 | 10/1963 | Collins et al. . | |
| 3,162,490 | 12/1964 | Koranda . | |
| 3,195,296 | 7/1965 | Janson | 55/298 |
| 3,204,391 | 9/1965 | Schwab | 55/374 |
| 3,204,392 | 9/1965 | Schwab | 55/381 |
| 3,258,173 | 6/1966 | Koranda | 222/189 |
| 3,261,148 | 7/1966 | Wurtenberg | 55/341 |
| 3,443,366 | 5/1969 | Schwab | 55/309 |
| 3,524,304 | 8/1970 | Wittemeierr | 55/374 |
| 3,537,241 | 11/1970 | Wiegel et al. | 55/378 |
| 3,538,686 | 11/1970 | Schwab | 55/377 |
| 3,797,891 | 3/1974 | Fritz . | |
| 3,871,848 | 3/1975 | Smith | 55/374 |
| 4,119,112 | 10/1978 | Adler | 220/89.2 X |
| 4,171,061 | 10/1979 | Burroughs et al. | 105/377.02 X |
| 4,200,200 | 4/1980 | Hein, III et al. | 221/48 |
| 4,604,203 | 8/1986 | Kyle | 210/489 |
| 4,793,509 | 12/1988 | Coleman | 220/203.08 |
| 4,795,051 | 1/1989 | Ou | 220/89.2 |
| 4,819,830 | 4/1989 | Schultz | 220/371 |
| 4,902,173 | 2/1990 | Hendee et al. | 406/41 |

FOREIGN PATENT DOCUMENTS

| | | |
|---|---|---|
| 176995 | 7/1957 | Sweden . |
| 879781 | 10/1961 | United Kingdom . |

*Primary Examiner*—Mark T. Le

*Attorney, Agent, or Firm*—Pravel, Hewitt, Kimball & Krieger

[57] ABSTRACT

A moisture barrier seal for use on a hopper car hatch opening that does not need to be removed before vacuum unloading of the hopper car due to the use of a grained plastic such as vertically drawn or cast polyethylene which will rupture as soon as the seal is subjected to the pressure differential across the seal created by the application of vacuum to the hopper car. The moisture barrier layer when combined with a filter layer forms a combination moisture barrier and filter seal.

12 Claims, 1 Drawing Sheet

MOISTURE BARRIER, FILTER SEAL FOR HOPPER RAIL CAR HATCHES

FIELD OF THE INVENTION

The invention is useful in the field of shipping materials in railroad hopper cars and in particular to such shipping where the material is a dry particulate which is transported in a hopper car equipped to permit vacuum unloading of the material.

BACKGROUND OF THE INVENTION

Railroad hopper cars are commonly used for transporting dry materials in bulk. Such cars typically include one or more large manhole size hatches on the top of the car for loading material into the car, with several smaller spouts on the bottom for unloading the material. Such cars are typically unloaded by applying a vacuum conveying line to an outlet gate positioned at the bottom of each car compartment. As can be appreciated, as material is drawn out from the car using the vacuum technique, it is essential that there be some opening in the top of the car to prevent a negative pressure that could cause the car or compartment to implode.

A recent development in hatch covers includes a vented hatch cover such as that shown in U.S. Pat. No. 4,819,830 to Salco Products, Inc., the teachings of which patent are hereby incorporated by reference. Such vented hatch covers avoid the need for a worker to climb to the top of the car to open one or more hatch covers or other air entry openings to provide the air inlet for pressure compensation.

It is of course important to protect the contents of the car from contamination during transportation and unloading. Although unvented hatch covers do not generally require any additional contamination protection during transportation, if they must be opened during the unloading process, contamination becomes a problem. For this reason, hatch seals which function as filters that permit air to be drawn into the hatch but filter out contaminants have been used. Such filters are shown in U.S. Pat. No. 4,902,173 to Hendee Enterprises, Inc., the teachings of which are hereby incorporated by reference. To protect the car contents from moisture during transportation, thin plastic membrane seals have also been used over the hatch openings, as mentioned in U.S. Pat. No. 4,902,173.

The use of plastic membrane seals which must be removed before the car can be unloaded takes away the labor and safety advantage of using a vented hatch cover because a worker must go atop the car to remove the seal from the hatch before the car can be unloaded. If the seal is not removed, it could act as an air infiltration barrier, which could cause the imploding problem or could result in the filter being drawn into the compartment and itself becoming a contaminant of the material.

Thus it would be desirable to have a moisture barrier that can be used with a vented hatch that provides a moisture barrier function until the car is ready to be unloaded but does not have to be removed before unloading the car. It would further be desirable to have a single seal which provides both a moisture barrier and a particulate filter which could be placed over the hatch after the car is loaded but does not have to be removed from the hatch before unloading the material from the hopper car.

SUMMARY OF THE INVENTION

The present invention provides a hopper car hatch seal which can be used with any hatch cover, but which is particularly useful with a vented hatch cover. The seal can be just a moisture barrier seal or can be a combination moisture barrier and filter seal. In either embodiment, the seal includes a moisture barrier layer made of a plastic chosen to rupture when the layer is subjected to the pressure differential across the hatch opening when vacuum is applied for unloading the car, i.e., about a quarter pound per square inch of pressure differential across the barrier. A preferred moisture barrier layer is made of a polyethylene film having a grain, such as is produced when the film is a vertically blown or cast. For a combination moisture barrier and filter, a preferred filter layer is spun nylon. The layer or layers can be conveniently constructed from circular layers of material gathered together to form a bonnet which can be secured about the hatch opening.

DETAILED DESCRIPTION

Figure 1:
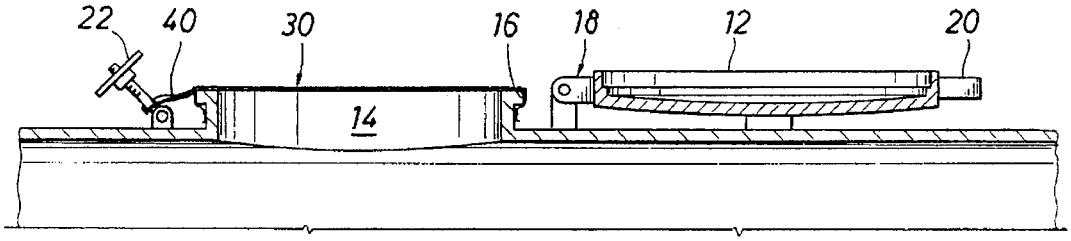
FIG. 1 is a side elevational view of a typical hopper car hatch cover in an open position and having a combination moisture barrier and filter seal mounted over the open hatch.

FIG. 1 illustrates the basic structure of a typical hatch opening 10 and hatch cover 12 used as the material loading port for a hopper car. Generally, the hatch opening 10 will be surrounded by a hatch coaming 14 which may include a turned over flange 16. The hatch cover 12 is mounted adjacent the coaming 14 by way of a hinge 18. The cover further typically includes some mechanism for securing the hatch cover 12 in place about the coaming 14, such as the eye extension 20 mounted on the cover and the opposing pawl 22 mounted adjacent the coaming 14 as shown in FIG. 1.

Figure 2:
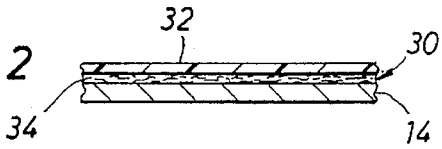
FIG. 2 is an enlarged partial cross-sectional view of one embodiment of a combination moisture barrier filter mounted on a hatch opening.
Figure 3:
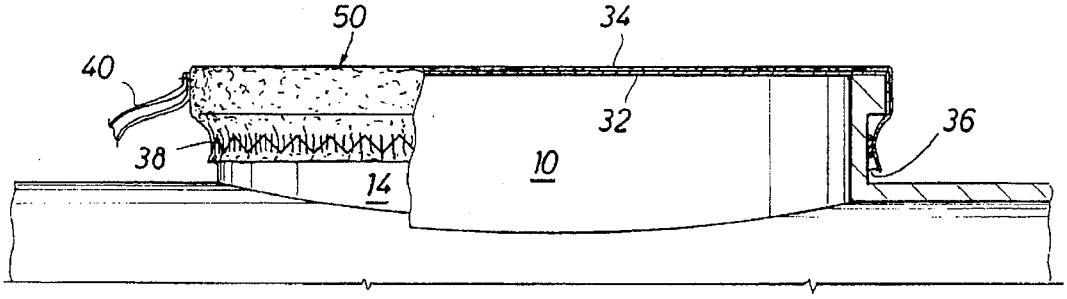
FIG. 3 shows an alternative embodiment of the combination seal of the invention having the relative orientation of the filter and moisture barrier layers reversed from that shown in FIG. 2.

One embodiment of a combination moisture barrier and filter seal 30 constructed in accordance with the present invention is shown in FIG. 2 and a second seal embodiment 50 is shown in FIG. 3. The seal 30 includes an upper moisture barrier layer 32 and a lower filter layer 34, while the seal 50 has the layers reversed. In both embodiments, the layers 32 and 34 are joined together at their outer edges and gathered to form a bonnet-shaped cover for placement over the coaming 14 as shown best in FIG. 3.

The seals 30 or 50 are most conveniently constructed by stitching the layers 32 and 34 along their margins to an elastic strip 38 by way of zig-zag stitching 36. Alternatively, two rows of stitching could be used to join the layers 32 and 34 and to form a channel for containing a drawstring (such as the drawstring 39 shown in FIG. 4) for both gathering the layers into a bonnet shape and for securing the seal 30 to the coaming 14. For additional security against the seal 30 falling through the hatch opening 10, a safety loop 40 (FIG. 1) may be provided which can be slipped over any convenient upright associated with the hatch cover, such as the pawl 22.

The material for the moisture barrier layer 32 should be chosen to have sufficient structural rigidity and strength so that it does not tear in handling and when placed over the coaming 14, but will quickly rupture when subjected to the initial pressure differential across the seal when vacuum unloading begins. That initial pressure differential is approximately one quarter pound per square inch of pressure, plus or minus about one sixteenth of a pound per square inch. In addition, it is preferred that the moisture barrier material have a grain structure. It has been found that the grain structure in a polyethylene material which has been vertically blown will rupture quickly along its grain lines and accomplish the desired result of providing entry for sufficient air during the vacuum unloading process to prevent implosion of the hopper compartment. In particular, a one mil thick, vertically blown, high density polyethylene film accomplishes the desired result. Other plastic films having a grain structure may also be suitable, such as a cast film having a grain, but at present such films are less economical to use in this application.

Although with a grained plastic film, the moisture barrier layer ruptures as illustrated in FIG. 3 without producing multiple pieces which might fall into the hopper car and become a contaminant to its contents, placing the filter layer between the hatch opening and the contents prevents any potential for such contamination. Thus with this arrangement of filter and plastic, a relatively thin, ungrained plastic film could be used. As can be appreciated, a more fragile film would provide the necessary rupture characteristic, i.e. it would rupture under the small one quarter pound per square inch pressure differential. However, such a film is more likely to be prematurely punctured or damaged such that it would lose its effectiveness as a moisture barrier. For this reason, a grained film such as the vertically blown or cast film is preferred.

Figure 4:
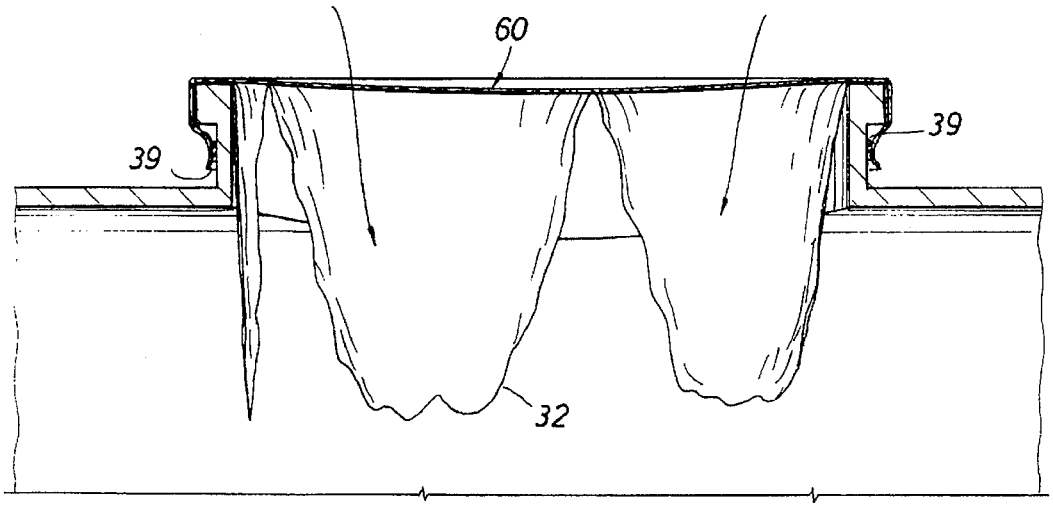
FIG. 4 is a view similar to FIG. 3 showing a moisture seal barrier in accordance with the invention after it has ruptured.

With the grained film, when the film ruptures, because of its strength in the non-grain direction, the film will stay affixed to the stitching 38, as illustrated in FIG. 4. Thus if no filter is needed or desired, a single layer seal such as seal 60 in FIG. 4, having only a moisture barrier film gathered to form a bonnet, would provide the moisture barrier feature. Because both moisture barrier and filter features are likely to be needed or desired, it is most economical and convenient to form a single seal having both the filter layer 34 and the moisture barrier layer 32.

If the moisture barrier layer 32 is placed in facing relationship to the contents of the rail car, such as is shown in FIG. 3, then both layers can be of the same size. However, if the filter layer is placed in facing relationship to the rail car contents as shown in FIG. 2, e.g., for added safety against pieces of the moisture layer falling into the rail car contents, because the filter layer does not stretch, that layer 32 will need to be larger than the film layer to accommodate stretching of the film layer just before it ruptures.

In particular, for the embodiment having the filter layer facing the rail car contents, to accommodate for the stretching of the polyethylene film before it ruptures, the seal should be oversized relative to the hatch opening so that, when subjected to the initial quarter pound pressure differential, the seal can move into the hatch opening a distance sufficient to accommodate the stretching without dislodging the gathering means, e.g., the elastic 36, from its position over the coaming 14. Using the above described film, it has been found that oversizing the filter layer 34 by several inches is sufficient to give the moisture barrier layer 32 room to stretch without damage to the filter layer 34. For example, a suitably sized cover for a typical circular hatch having a twenty inch diameter opening would have a circular moisture barrier layer 32 of about thirty inches, to allow for the margin needed for it to be gathered about the coaming, and a filter layer 34 having about a thirty-four inch diameter, to allow four inches for the moisture barrier layer to stretch before it ruptures.

The filter layer 34 can be any filter medium capable of filtering out contaminants down to about 30 microns while allowing an air flow of at least about 280 cubic feet per minute per square foot. A spun bonded nylon fabric is suitable from its functional characteristics and also works well with a stitching method of construction.

As can now be appreciated, the hatch seal of the present invention can be constructed using various other methods and materials without departing from the spirit of the invention, the scope of which is defined by the following claims.

What is claimed is:

1. A seal for covering a hatch opening of a bulk particulate materials container and providing moisture and particulate contamination protection of the container contents comprising:

a moisture barrier material and a filter material joined at their margins, said moisture barrier material having a film thickness and a grain structure such that when subjected to as little as a quarter pound per square inch of pressure differential across said moisture barrier material said moisture barrier material will rupture along its grain lines; and means for gathering the joined materials to form a bonnet sized to fit over the hatch opening.

2. The seal of claim 1 wherein the moisture barrier material is a plastic.

3. The seal of claim 2 wherein the plastic is a vertically blown polyethylene.

4. The seal of claim 1 wherein the filter material is a spun nylon.

5. The seal of claim 1 wherein the gathering means is an elastic material.

6. The seal of claim 1 wherein the gathering means is a drawstring.

7. A seal for covering a hatch opening of a bulk particulate materials container and providing moisture and particulate contamination protection of the container contents comprising:

a moisture barrier material and a filter material joined at their margins, said moisture barrier material having a film thickness such that when subjected to as little as a quarter pound per square inch of pressure differential across said moisture barrier material, said moisture barrier material will rupture; and means for gathering the joined materials to form a bonnet sized to fit over the hatch opening.

8. The seal of claim 7, wherein the moisture barrier material is a plastic.

9. The seal of claim 8, wherein the plastic is a vertically blown polyethylene.

10. The seal of claim 7, wherein the filter material is a spun nylon.

11. The seal of claim 7, wherein the gathering means is an elastic material.

12. The seal of claim 7, wherein the gathering means is a drawstring.

* * * * *